United States Patent [19]

Hardy et al.

[11] 4,294,710

[45] Oct. 13, 1981

[54] DETERGENT SOFTENER WITH AMINE INGREDIENT

[75] Inventors: Frederick E. Hardy, Gosforth; Colin A. Dewar, Tweedmouth, both of England

[73] Assignee: The Procter & Gamble Company, Cincinnati, Ohio

[21] Appl. No.: 164,446

[22] Filed: Jun. 30, 1980

[30] Foreign Application Priority Data

Jul. 5, 1979 [GB] United Kingdom ..... 23527/79

[51] Int. Cl.[3] ..... D06M 11/04; D06M 13/36; D06M 13/46

[52] U.S. Cl. ..... 252/8.8; 252/544; 252/525; 252/548; 252/529; 252/542; 252/524

[58] Field of Search ..... 252/544, 525, 548, 529, 252/542, 524, 8.8

[56] References Cited

U.S. PATENT DOCUMENTS

| | | | |
|---|---|---|---|
| 3,154,489 | 10/1964 | Du Brow et al. | 252/8.8 X |
| 3,886,098 | 5/1975 | Di Salvo et al. | 252/540 |
| 3,936,537 | 2/1976 | Baskerville et al. | 252/8.8 X |
| 4,038,196 | 7/1977 | Minegishi et al. | 252/547 X |
| 4,134,840 | 1/1979 | Minegishi et al. | 252/8.8 X |

FOREIGN PATENT DOCUMENTS

| | | | |
|---|---|---|---|
| 1514276 | 6/1978 | United Kingdom | 252/8.6 |

*Primary Examiner*—Mayer Weinblatt

[57] ABSTRACT

Detergent compositions having good cleaning performance and also textile softening properties comprise an organic surfactant, alkaline reacting water-soluble salts and a specified class of tertiary amines. Optionally and preferably a smectite-type clay is also present in the compositions.

The present invention relates to detergent compositions which clean well and at the same time act as textile softeners.

6 Claims, No Drawings

DETERGENT SOFTENER WITH AMINE INGREDIENT

THE STATE OF THE ART

Numerous attempts have been made to formulate laundry detergent compositions which provide the good cleaning performance expected of them and which also have textile softening properties. Thus, attempts have been made to incorporate cationic textile softeners in anionic surfactant-based built detergent compositions employing various means of overcoming the natural antagonism between the anionic and cationic surfactant species. For instance, the British Pat. No. 1,518,529, detergent compositions are described comprising organic surfactant, builders, and, in particulate form, a quaternary ammonium softener combined with a poorly water-soluble dispersion inhibitor which inhibits premature dispersion of the cationic in the wash liquor. Even in these compositions some compromise between cleaning and softening effectiveness has to be accepted. Another approach to providing built detergent compositions with softening ability has been to employ nonionic surfactants instead of anionic with cationic softeners, and compositions of this type have been described in, for example, British Pat. No. 1,079,338, German Auslegeschrift No. 1,220,956 and U.S. Pat. No. 3,607,763. However, it is found that if enough nonionic surfactant is employed to provide good cleaning, it impairs the softening effect of the cationic softener, so that, once again, a compromise between cleaning and softening effectiveness must be accepted.

Recently it has been disclosed in British Pat. No. 1,514,276 that certain tertiary amines with two long chain alkyl or alkenyl groups and one short chain alkyl group are effective fabric softeners in detergent compositions when chosen to have an isoelectric point in the pH range such that they are in amine form present as a dispersion of negatively charged droplets in a normal alkaline wash liquor and are more in cationic (salt) form at the lower pH of a rinse liquor, and so become substantive to fabrics. Use of amines of this class, amongst others, in detergent compositions has also been previously disclosed in British Pat. No. 1,286,054. Another approach to providing anionic detergent compositions with textile softening ability has been the use of smectite-type clays, as described in British Pat. No. 1,400,898. These compositions, although they clean well, require rather large contents of clay for effective softening, perhaps because the clay is not very efficiently deposited on the fabrics in the presence of anionic surfactants.

The use of clay together with a water insoluble cationic compound and an electrically conductive metal salt as a softening composition adapted for use with anionic, nonionic, zwitterionic and amphoteric surfactants has been described in British Pat. No. 1,483,627. Our copending patent application U.S. Ser. No. 962452 describes granular textile softening compositions comprising a complex of a cationic softener and a smectite type clay subsequently treated with an anionic surfactant. These compositions are intended mainly as rinse additives, where their cleaning performance is not of primary interest.

More recently, our copending European patent application No. 7920006591 discloses a combination of a specified class of tertiary amines and a smectite-type clay in or with alkaline detergent compositions, whereby pronounced textile softening properties are provided without reduction of the cleaning performance of the detergent composition.

SUMMARY OF THE INVENTION

It has now been found that certain other tertiary amines can provide textile softening performance when incorporated in an alkaline detergent composition or when employed together with an alkaline detergent composition, without impairing the cleaning performance of the detergent composition. Furthermore, these tertiary amines are even more effective when employed together with a smectite-type clay.

According to the invention there is provided a textile softening detergent composition comprising, by weight:

(a) from 3 to 30% of an organic surfactant, (b) from 1 to 25% of:

(i) a tertiary amine having the formula:

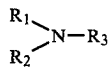

wherein $R_1$ and $R_2$ each independently represents a $C_{10}$ to $C_{26}$ alkyl or alkenyl group, and $R_3$ represents a group selected from

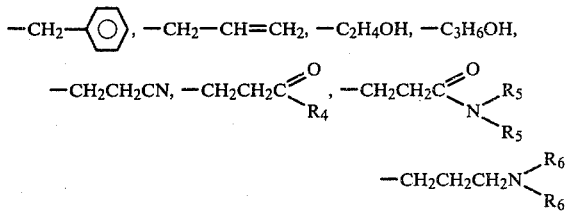

wherein $R_4$ is a $C_{1-4}$ alkyl group, each $R_5$ independently is H or a $C_{1-4}$ alkyl group, and each $R_6$ independently is H or a $C_{1-20}$ alkyl group, (ii) an imidazoline derivative of formula

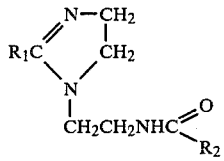

wherein $R_1$ and $R_2$ have the meanings given above or (iii) mixtures of any of (i) and (ii), and (c) from 10% to 80% of one or more water soluble inorganic or organic salts such that the pH of a 0.5% by weight aqueous solution of the composition is in the range from 8.5 to 11, preferably from 9.0 to 10.5.

Preferred compositions also contain:

(d) up to 35% of an impalpable smectite-type clay having an ion exchange capacity of at least 50 meq. per 100 grams.

In these latter compositions it is preferred that the weight ratio of tertiary amine to clay be in the range from 10:1 to 1:10, especially 2:1 to 1:3.

DETAILED DESCRIPTION OF THE INVENTION

Organic Surfactant

Anionic surfactants are much preferred for optimum combined cleaning textile softening performance, but other classes of organic surfactants and mixtures thereof may be used. Among these are nonionic surfactants, such as the ethoxylated fatty alcohols and alkyl phenols well known in the art, examples being $C_{10}$–$C_{18}$ alcohols ethoxylated with from 5–11 ethylene oxide groups per mole of alcohol and $C_6$–$C_{12}$ alkyl phenols ethoxylated with from 2–9 ethylene oxide groups per mole of alkyl phenol. Preferred nonionic surfactants are the primary $C_{14}$–$C_{18}$ alcohols ethoxylated with from 7–11 moles of ethylene oxide per mole of alcohol, specific examples being $C_{14}$–$C_{15}$ alcohol $(EO)_7$ and $C_{16}$–$C_{18}$ alcohol $(EO)_{11}$. However for optimum cleaning and softening performance, compositions containing anionic surfactants include no, or at most only low levels of nonionic surfactants viz. less than 4% by weight of the composition preferably less than 2% by weight. It is also highly preferable that the anionic surfactant forms the major part of the mixture.

Suitable anionic non-soap surfactants are water soluble salts of alkyl benzene sulfonates, alkyl sulfates, alkyl polyethoxy ether sulfates, paraffin sulfonates, alphaolefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonates, and beta-alkoxy alkane sulfonates. Soaps are also suitable anionic surfactants.

Especially preferred alkyl benzene sulfonates have about 9 to about 15 carbon atoms in a linear or branched alkyl chain, more especially about 11 to about 13 carbon atoms. Suitable alkyl sulfates have about 10 to about 22 carbon atoms in the alkyl chain, more especially from about 12 to about 18 carbon atoms. Suitable alkyl polyethoxy ether sulfates have about 10 to about 18 carbon atoms in the alkyl chain and have an average of about 1 to about 12 $—CH_2CH_2O—$ groups per molecule, especially about 10 to about 16 carbon atoms in the alkyl chain and an average of about 1 to about 6 $—CH_2CH_2O—$ groups per molecule.

Suitable paraffin sulfonates are essentially linear and contain from about 8 to about 24 carbon atoms, more especially from about 14 to about 18 carbon atoms. Suitable alpha-olefin sulfonates have about 10 to about 24 carbon atoms, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Suitable alpha-sulfocarboxylates contain from about 6 to about 20 carbon atoms; included herein are not only the salts of alpha-sulfonated fatty acids but also their esters made from alcohols containing about 1 to about 14 carbon atoms.

Suitable alkyl glyceryl ether sulfates are ethers of alcohols having about 10 to about 18 carbon atoms, more especially those derived from coconut oil and tallow. Suitable alkyl phenol polyethoxy ether sulfates have about 8 to about 12 carbon atoms in the alkyl chain and an average of about 1 to about 6 $—CH_2CH_2O—$ groups per molecule. Suitable 2-acyloxy-alkane-1-sulfonates contain from about 2 to about 9 carbon atoms in the alkane moiety. Suitable beta-alkyloxy alkane sulfonates contain about 1 to about 3 carbon atoms in the alkyl group and about 8 to about 20 carbon atoms in the alkane moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanol ammonium cations; sodium is preferred. Mixtures of anionic surfactants are contemplated by this invention; a satisfactory mixture contains alkyl benzene sulfonate having 11 to 13 carbon atoms in the alkyl group and alkyl sulfate having 12 to 18 carbon atoms in the alkyl group.

Suitable soaps contain about 8 to about 24 carbon atoms, more especially about 12 to about 18 carbon atoms. Soaps can be made by direct saponification of natural fats and oils such as coconut oil, tallow and fish oil, or by the neutralization of free fatty acids obtained from either natural or synthetic sources. The soap cation can be alkali metal, ammonium or alkanolammonium; sodium is preferred.

The compositions contain from 3 to 30% of organic detergent, preferably from 5 to 25% of anionic detergent.

THE TERTIARY AMINES

Suitable amines are highly water insoluble amines of the structural formula

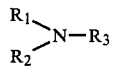

I where $R_1$ and $R_2$ having the meanings defined above. Preferably $R_1$ and $R_2$ each independently represents a $C_{12}$ to $C_{22}$ alkyl group, preferably straight chained. $R_3$ as stated above, represents

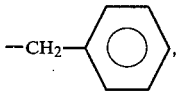

$—CH_2—CH{=}CH_2$ $—C_2H_4OH$, $—C_3H_6OH$, or $—CH_2CH_2CN$, i.e. benzyl, allyl, hydroxyethyl, hydroxypropyl, or 2-cyanoethyl. Thus suitable amines include:

didecyl benzylamine
dilauryl benzylamine
dimyristyl benzylamine
dicetyl benzylamine
distearyl benzylamine
dioleyl benzylamine
dilinoleyl benzylamine
diarachidyl benzylamine
dibehenyl benzylamine
di (arachidyl/behenyl) benzylamine
ditallowyl benzylamine and the corresponding allylamines, hydroxy ethylamines, hydroxy propylamines, and 2-cyanoethylamines. Especially preferred are ditallowyl benzylamine and ditallowyl allylamine.

Also suitable are the corresponding tertiary amines containing the groups:

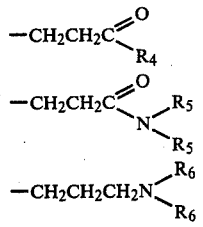

wherein $R_4$ represents a $C_{1-4}$ alkyl group, and each $R_5$ independently represents H or a $C_{1-4}$ alkyl group, and each $R_6$ independently represents H or a $C_{1-20}$ alkyl group.

Some nonlimiting examples of these compounds are:

1-ditallowylamino-butan-3-one 3-ditallowylamino-proprionamide

N,N-ditallowyltrimethylene diamine

N,N-ditallowyl-$N^1N^1$-dimethyltrimethylenediamine

N,N,$N^1$,$N^1$-tetratallowyl trimethylenediamine and corresponding compounds where the ditallowyl group is replaced by dialkyl and dialkenyl groups as described above.

These amines may be prepared by methods known in the art. Thus the benzyl, allyl, hydroxyalkyl and trimethylenediamine bodies may be prepared by reaction of the appropriate di-long chain secondary amine with an appropriate halogen derivative. The class typified by the 2-cyanoethyl derivative are normally prepared by reaction of the secondary amine with an appropriate compound containing an electron-deficient double bond.

Yet other amine derivatives which may be employed are the imidazoline derivatives having the formula

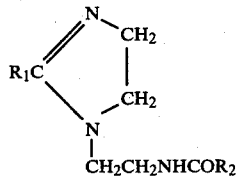

where $R_1$ and $R_2$ have the meanings given above.

These imidazolinederivatives may be prepared by methods known in the art. Preferably $R_1$ and $R_2$ are heptadecyl or $R_1$ and —$COR_2$ are each derived from tallow.

Mixtures of any of these amines may be used.

Usually the detergent compositions contain from 2% to 15% by weight of the tertiary amine, especially from about 4% to about 8%.

WATER SOLUBLE SALTS

The compositions of the invention contain from 10% to 80% of water soluble salts, preferably from 20% to 70% and most usually from 30% to 60%, and these may be any which are such that the detergent composition in a 0.5% by weight aqueous solution has pH in the specified range, that is from 8.5 to 11, preferably from 9.0 to 10.5. At this pH the tertiary amines of the invention are present in the form of a dispersion of negatively charged droplets and are therefore compatible with anionic surfactants.

Preferably, the water soluble salts are, or consist predominantly of, detergency builders and these can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, and silicates. Specific examples of such salts include the sodium and potassium tetraborates, bicarbonates, carbonates, tripolyphosphates, pyrophosphates, penta-polyphosphates and hexametaphosphates. Sulphates are usually also present.

Examples of suitable organic alkaline detergency builders salts are:

(1) water-soluble amino polyacetates, e.g., sodium and potassium ethylenediaminetetraacetates, nitrilotriacetates, N-(2-hydroxyethyl) nitrilodiacetates and diethylenetriamine pentaacetates;

(2) water-soluble salts of phytic acid, e.g. sodium and potassium phytates;

(3) water-soluble polyphosphonates, including sodium, potassium and lithium salts of methylenediphosphonic acid and the like and aminopolymethylene phosphonates such as ethylenediaminetetramethylenephosphonate and diethylenetriaminepentamethylene phosphonate, and polyphosphonates described in British patent application No. 38724/77.

(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders can be used herein. One such mixture of builders is disclosed in Canadian Pat. No. 755,038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprises a water-soluble material capable of forming a water-insoluble reaction product with water hardness cations preferably in combination with a crystallization seed which is capable of providing growth sites for said reaction product. Such "seeded builder" compositions are fully disclosed in British Pat. No. 1,424,406.

Preferred water soluble builders are sodium tripolyphosphate and sodium silicate, and usually both are present. In particular, it is preferred that a substantial proportion, for instance from 3 to 15% by weight of the composition of sodium silicate (solids) of ratio (weights ratio $SiO_2$:$Na_2O$) from 1:1 to 3.5:1 be employed.

A further class of detergency builder materials useful in the present invention are insoluble sodium aluminosilicates, particularly those described in Belgian Pat. No. 814,874. This patent discloses and claims detergent compositions containing crystalline sodium aluminosilicate of the formula $$Na_z(AlO_2)_z(SiO_2)_y xH_2O$$

wherein z and y are integers equal to at least 6, the molar ratio of z to y is in the range of from 1.0:1 to about 0.5:1 and x is an integer from about 15 to about 264. A preferred material is $Na_{12}(SiO_2AlO_2)_{12}\ 27H_2O$. If present, incorporation of about 5% to about 25% by weight of aluminosilicate is suitable, partially replacing water soluble builder salts, provided that sufficient water soluble alkaline salts remain to provide the specified pH of the composition in aqueous solution.

Preferably the compositions contain from 20% to 70% of soluble and/or insoluble builders, more usually from 30% to 60%.

OPTIONAL COMPONENTS (1) Smectite Clay

A highly preferred optional component of formulations in accordance with the present invention is a smectite clay, which serves to provide additional fabric softening performance. The smectite clays particularly useful in the practice of the preferred embodiment of the present invention are sodium and calcium montmorillonites, sodium saponites, and sodium hectorites. The clays used herein have particle size which cannot be perceived tactilely. Impalpable clays have particle sizes below about 50 microns; the clays used herein normally have a particle size range of from about 5 microns to about 50 microns.

The clay minerals can be described as expandable, three-layer clays, i.e., aluminosilicate and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{4-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0. Of these only montmorillonites having exchange capacities greater that 50 meq/100 g. are suitable for the present invention and provide fabric softening benefits.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)(Mg_{6-x}Al_x)O_{20}$, sauconite $(OH)_4Si_{8-y}Al_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and X has a value of 0 to about 6.0. Hectorite and saponite are the only minerals in this class that are of value in the present invention, the fabric softening performance being related to the type of exchangeable cation as well as to the exchange capacity. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure.

As noted hereinabove, the clays employed in the compositions of the present invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation.

$$\text{Smectite clay } (Na)^+ \rightleftharpoons \text{smectite clay } (NH_4) + NaOH$$

Since on the foregoing equilibrium reaction one equivalent weight on ammonium ion replaces an equivalent weight of sodium, it is customary to measure cation exchange capacity (sometimes termed "base exchange capacity") in terms of milli-equivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. for kaolinites to about 150 meq/100 g., and greater, for certain smectite clays. Illite clays although having a three layer structure, are of a non-expanding lattice-type and have an ion exchange capacity somewhere in the lower portion of the range, i.e., around 26 meq/100 g. for an average illite clay. Attapulgites, another class of clay minerals, have a spicular (i.e. needle-like) crystalline form with low cation exchange capacity (25–30 meq/100 g.). Their structure is composed of chains of silica tetrahedrons linked together by octahedral groups of oxygens and hydroxyls containing Al and Mg atoms.

It has been determined that illite, attapulgite, and kaolinite clays, with their relatively low ion exchange capacities, are not useful in the present compositions. However, the alkali metal montmorillonites, saponites, and hectorites, and certain alkaline earth metal varieties of these minerals such as calcium montmorillonites have been found to show useful fabric softening benefits when incorporated in the compositions in accordance with the present invention.

Specific non-limiting examples of such fabric softening smectite clay minerals are:

| |
|---|
| Montmorillonites |
| Brock |
| Volclay BC |
| Gelwhite GP |
| Thixo-Jel |
| Ben-A-Gel |
| Soft Clark |
| Gelwhite L |
| Imvite K |
| Hectorites |
| Veegum F |
| Laponite SP |
| Barasym LIH 200 |
| Saponites |
| Barasym NAS 100 |

Accordingly, smectite clays useful herein can be characterised as montmorillonite, hectorites, and saponite clay minerals having an ion exchange capacity of at least about 50 meq/100 g. and preferably at least 60 meq/100 g. Most of the smectite clays useful in the compositions herein are commercially available under various trade names, for example, Thixogel 1 and Gelwhite GP from Georgia Kaolin Col., Elizabeth, N.J.;

Imvite K from Industrial Mineral Ventures; Volclay BC and Volclay 325, from American Colloid Co., Skokie, Ill.; and Veegum F, from R. T. Vanderbilt. It is to be recognised that such smectite minerals obtained under the foregoing tradenames can comprise mixtures of the various discrete mineral entities. Such mixtures of the smectite minerals are suitable for use herein.

Within the classes of montmorillonites, hectorite and saponite clay minerals having a cation exchange capacity of at least about 50 meq/100 g., certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in detergent softening composition. Imvite K is also very satisfactory.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e., they display swelling characteristics in aqueous media. Conversely they do not swell in nonaqueous or predominantly nonaqueous systems.

The clay containing compositions according to the invention contain up to 35% by weight of clay, preferably from about 4% to about 15%, especially from about 5% to about 12%.

(2) Other Optional Components

The optional components usual in built laundry detergents may of course be present. These include bleaching agents such as sodium perborate, sodium percarbonate and other perhydrates, at levels from about 5% to 35% by weight of the composition, and activators therefor, such as tetra acetyl ethylene diamine, tetra acetyl glycouril and others known in the art, and stabilisers therefor, such as magnesium silicate, and ethylene diamine tetra acetate.

Certain polyphosphonates may be present, serving to improve the effectiveness of the compositions for removing bleachable stains. These have the formula

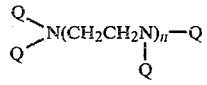

where n is 0 to 2, and each Q independently is H or $—CH_2PO_3H_2$, or a water soluble salt thereof, provided that at least half of the radicals Q are $—CH_2PO_3H_2$ radicals or salts thereof. Especially preferred are ethylene diamine tetra methylenephosphonates, diethylenetriamine pentamethylenephosphonates and nitrilo trimethylenephosphonates.

Suds controlling agents are often present. These include suds boosting or suds stabilising agents such as mono- or di-ethanolamides of fatty acids. More often in modern detergent compositions, suds suppressing agents are required. Soaps especially those having 16–22 carbon atoms, or the corresponding fatty acids, can act as effective suds suppressors if included in the anionic surfactant component of the present compositions. Usually about 1% to about 4% of such soap is effective as a suds suppressor. Very suitable soaps when suds suppression is a primary reason for their use, are those derived from Hyfac (Trade Name for hardened marine oil fatty acids predominantly $C_{18}$ to $C_{20}$).

However, non-soap suds suppressors are preferred in synthetic detergent based compositions of the invention since soap or fatty acid tends to give rise to a characteristic odour in these compositions.

Preferred suds suppressors comprise silicones. In particular there may be employed a particulate suds suppressor comprising silicone and silanated silica releasably enclosed in water soluble or dispersible substantially non-surface active detergent impermeable carrier. Suds suppressing agent of this sort are disclosed in British Pat. No. 1,407,997. A very suitable granular (prilled) suds suppressing product comprises 7% silica/silicone (15% by weight silanated silica, 85% silicone, obtained from Messrs. Dow Corning), 65% sodium tripolyphosphate, 25% Tallow alcohol condensed with 25 molar proportions of ethylene oxide, and 3% moisture. The amount of silica/silicone suds suppressor employed depends upon the degree of suds suppression desired but it is often in the range from 0.01% to 0.5% by weight of the detergent composition. Other suds suppressors which may be used are water insoluble, preferably microcrystalline, waxes having melting point in the range from 35° to 125° C. and saponification value less than 100, as described in British Pat. No. 1,492,938.

Yet other suitable suds suppressing systems are mixtures of hydrocarbon oil, a hydrocarbon wax and hydrophobic silica as described in published European patent application No. 0000216 and, especially, particulate suds suppressing compositions comprising such mixtures, combined with a nonionic ethoxylate having hydrophilic lipophilic balance in the range from 14–19 and a compatibilising agent capable of forming inclusion compounds, such as urea. These particulate suds suppressing compositions are described in European published patent application No. 0008830.

Soil suspending agents are usually present at about 0.1 to 10%, such as water soluble salts of carboxymethyl cellulose, carboxyhydroxymethyl cellulose, polyethylene glycols of molecular weight from about 400 to 10000 and copolymers of methylvinylether and maleic anhydride or acid, available under the Trade Name Gantrez.

Proteolytic, amylolytic or lipolytic enzymes, especially proteolytic, and optical brighteners, of anionic, cationic or nonionic types, especially the derivatives of sulphonated triazinyl diamino stilbene may be present.

Colours, non-substantive, and perfumes, as required to improve the aesthetic acceptability of the product, are usually incorporated.

Throughout the description herein where sodium salts have been referred to, potassium, lithium or ammonium or amine salts may be used instead if their extra cost etc. are justified for special reasons.

PREPARATION OF THE COMPOSITIONS

The detergent compositions may be prepared in any way, as appropriate to their physical form, as by mixing the components, co-agglomerating them or dispersing them in a liquid carrier. Preferably the compositions are granular and are prepared by spray drying an aqueous slurry of the non-heat-sensitive components to form spray dried granules into which may be admixed the heat sensitive components such as persalts, enzymes, perfumes etc. Although the amine may be included in the slurry for spray drying, it is preferred that it be incorporated by being sprayed in liquid preferably molten form on the spray dried granules before or after other heat sensitive solids have been dry mixed with them. Although the amine is generally a waxy solid of rather low melting point, the granules so made are surprisingly crisp and free-flowing. Alternatively the amine in liquid form may be sprayed onto any particulate component or components of the composition which are able to act as carrier granules. The clay component may be added to the slurry for spray drying or may be dry mixed, as preferred for reasons unrelated to its softening effect, such as for optimum colour of the product.

EXAMPLES

Textile softening detergent compositions were prepared having the formulae, in parts percent by weight:

| Example | | 1* | 2 | 3 |
|---|---|---|---|---|
| (a) | Sodium linear dodecyl benzene sulphonate | 8 | 8 | 8 |
| (a) | Sodium tripolyphosphate | 32 | 32 | 32 |
| (a) | Sodium silicate (Ratio $SiO_2/Na_2O$-2) | 6 | 6 | 6 |
| (a) | Sodium sulphate | 21 | 9 | 5 |
| (c) | Sodium perborate | 25 | 25 | 25 |
| (a) | Sodium carboxymethyl cellulose | 0.8 | 0.8 | 0.8 |
| (a) | Sodium ethylene diamine tetraacetate | 0.2 | 0.2 | 0.2 |
| (c) | Enzyme granules | 0.4 | 0.4 | 0.4 |
| (a) | Optical brightener | 0.2 | 0.2 | 0.2 |
| (b) | Perfume | 0.25 | 0.25 | 0.25 |
| (c) | Silica/silicone suds suppressor** | 0.15 | 0.15 | 0.15 |
| (a) | Clay (montmorillonite)*** | — | — | 10 |
| (b) | Ditallowyl benzylamine | — | 12 | 6 |
| — | Water | 6 | 6 | 6 |

*Example 1 is for comparison
**Silica-dimethylsiloxane in weight ratio 10:90
***"Imvite K"-Trade name of Messrs. Industrial Mineral Ventures (I.M.V.)

The compositions were prepared by making spray dried granules containing components (a), spraying components (b) onto them in a rotating drum, and dry mixing the resulting granules with components (c). 0.5% solutions of the compositions in water at 20° C. had pH 9.0–10.1. The compositions of examples 2 and 3 had as good cleaning performance as that of the reference example 1. Cotton test pieces washed amongst a naturally soiled wash load with the compositions of examples 2 and 3 were softer in feel than similar pieces washed with the composition of example 1.

Similar performance was obtained when the ditallowyl benzylamine was replaced by ditallow hydroxyethylamine, ditallowyl allylamine or ditallowyl-2-cyanoethylamine, and is obtained when the ditallowyl group is replaced by a dicoconut, dimyristyl, dipalmityl, dioleyl, diarachidyl, or di (arachidyl/behenyl) group.

Similar performance is obtained when the "Imvite K" clay is replaced by Volclay BC, Gelwhite GP, Soft Clark, or Gelwhite L. These are montmorillonites; Volclay is a Trade name of American Colloids Co.; Gelwhite and Soft Clark are Trade names of Georgia Kaolin Co.

Similar performance is obtained when the 8% linear alkyl benzene sulphonate (LAS) is replaced by a mixture of 4% LAS and 4% sodium coconut alkyl sulphate, or by a mixture of 5% LAS and 3% sodium tallow alkyl sulphate.

Similar performance is obtained if the clay is dry mixed together with components (c) instead of being added to the slurry for spray drying with components (a).

EXAMPLES 4 AND 5

Textile softening detergent compositions were prepared having the following formulae in parts percent by weight.

| Example | 4 | 5 |
|---|---|---|
| Sodium linear dodecyl benzene sulphonate | 8 | 8 |
| Sodium tripolyphosphate | 23 | 23 |
| Sodium silicate (Ratio $SiO_2$:$Na_2O$ 1.6) | 10 | 10 |
| Sodium sulphate | 6.8 | 6.8 |
| Sodium perborate | 25 | 25 |
| Sodium carboxymethyl cellulose | 0.8 | 0.8 |
| Sodium ethylene diamine tetraacetate | 0.2 | 0.2 |
| Enzyme granules | 0.6 | 0.6 |
| Optical brightener | 0.2 | 0.2 |
| Perfume | 0.25 | 0.25 |
| Silica/silicone suds Suppressor | 0.15 | 0.15 |
| Poly (methyl vinyl ether-maleic anhydride) | 1 | 1 |
| Clay (montmorillonite) | 10 | 10 |
| NN-Ditallowyl trimethylenediamine | 6 | — |
| $NNN^1N^1$ tetratallowyl trimethylene diamine | — | 6 |
| Water | 8 | 8 |

These compositions were prepared as were those of Examples 1–3 and 0.5% solutions of the compositions in water had pH from 9.3 to 10.5. These compositions had as good cleaning performance as that of reference compositions identical in formulation except in containing additional sodium sulphate in place of the clay and tertiary amine, and cotton test pieces washed with a naturally soiled wash load with the compositions of Examples 4 and 5 were softer in feel than similar pieces washed in said reference composition.

EXAMPLES 6–10

The following compositions are prepared substantially as described in example 1, and provide cleaning and textile softening benefits. Quantities are in parts percent by weight.

| Example | 6 | 7 | 8 | 9 | 10 |
|---|---|---|---|---|---|
| Sodium linear dodecyl benzene sulphonate | 15 | 5 | 8 | 10 | — |
| Sodium tallow alkyl sulphate | — | 5 | — | — | — |
| Sodium soap (80/20) Tallow-coconut) | — | 3 | — | — | 45 |
| Sodium tripolyphosphate | 30 | 44 | 12 | 5 | 5 |
| Sodium carbonate | 4 | — | — | 14 | 20 |
| Sodium silicate | 8 | 6 | 10 | 8 | 10 |
| Sodium sulphate | 12 | 8 | 6 | 8 | — |
| Sodium perborate tetrahydrate | 7 | 10 | 20 | — | — |
| Sodium alumino silicate | — | — | 20 | — | — |
| Sodium carboxymethyl cellulose | 1 | 1 | 1 | 1 | — |
| Sodium ethylenediamine | | | | | |

-continued

| Example | 6 | 7 | 8 | 9 | 10 |
|---|---|---|---|---|---|
| tetra acetate | 0.2 | 0.2 | 0.2 | — | — |
| Enzyme granules | 0.5 | 0.5 | 0.5 | — | — |
| Optical brightener | 0.3 | 0.3 | 0.3 | — | 0.3 |
| Clay (Imvite K) | 4 | 8 | 10 | 30 | 3 |
| Ditallowyl benzylamine | 10 | 2 | 6 | 20 | 4 |
| Moisture etc. | 8 | 7 | 6 | 4 | 12.7 |

EXAMPLES 11-13

Textile softening detergent compositions have the following compositions.

| Example | 11 | 12 | 13 |
|---|---|---|---|
| Sodium dodecyl benzene sulphonate | 8 | 8 | 8 |
| Sodium tripolyphosphate | 28 | 28 | 28 |
| Sodium silicate (Ratio $SiO_2/Na_2O$ 2.0) | 6 | 6 | 6 |
| Sodium sulphate | 13.9 | 13.9 | 5.9 |
| Sodium perborate | 25 | 25 | 25 |
| Sodium carboxymethyl cellulose | 1 | 1 | 1 |
| Enzyme, Optical brightener Perfume | 1 | 1 | 1 |
| Silica/silicone suds suppressor | 0.15 | 0.15 | 0.15 |
| Poly (methyl vinyl ether-maleic anhydride) | 1 | 1 | 1 |
| NN-ditallowyl trimethylene diamine | 8 | — | — |
| 2-tallowyl-4,5-dihydro-1 stearoylamidoethyl-imidazole | — | 8 | 6 |
| Clay (montmorillonite) | — | — | 10 |
| Water | 8 | 8 | 8 |

These compositions provide equal cleaning and better softness of washed fabrics than the corresponding composition wherein the amine and clay have been replaced by additional sodium sulphate.

Similar performance is obtained where in example 11 the ditallowyl propylenediamine is replaced by an equal amount of N,N-ditallowyl propionamine or N,N-ditallowyl methyl propionate.

| Examples 14-17 | 14 | 15 | 16 | 17 |
|---|---|---|---|---|
| Sodium dodecyl benzene sulphonate | 6.5 | 5 | 6.5 | 6.5 |
| Sodium tallow alkyl sulphate | | 2 | | |
| $C_{14}$-$C_{15}$ primary alcohol $(EO)_7$ | 2 | | | |
| Tallow alcohol ($C_{16}$-$C_{18}$) $(EO)_{11}$ | | 1 | 1 | 1 |
| Sodium tripolyphosphate | 24 | 16 | 30 | 24 |
| Sodium silicate (Ratio $SiO_2$: $Na_2O$ 2.0:1) | 6 | 6 | 6 | 6 |
| Sodium perborate | 25 | 25 | 25 | 25 |
| Sodium Zeolite Type A | | 16 | | |
| Sodium carboxymethyl cellulose | | | 1 | |
| Maleic anhydride methyl vinyl ether copolymer | 1 | | | 1 |
| N-N ditallow trimethylene diamine | | 6 | | 5 |
| Ditallow benzylamine | 6 | | 5 | |
| Silica-silicone suds suppressor | 0.2 | 0.15 | 0.2 | 0.2 |
| Enzyme, optical brightener, perfume | 1 | 1 | 1 | 1 |
| Sodium sulphate | 14.3 | 7.85 | 10.3 | 16.3 |
| Smectite Clay | 6 | 6 | 6 | 6 |
| Water | 8 | 8 | 8 | 8 |

We claim:

1. A method of preparing a detergent composition adapted to provide fabric softening benefits when used to wash textiles, said method constituting the steps of (a) forming a slurry containing (i) an anionic surfactant selected from the group consisting of sodium and potassium $C_9$-$C_{15}$ alkyl benzene sulphonates, $C_{12}$-$C_{18}$ alkyl sulphates and $C_{12}$-$C_{18}$ alkyl polyethoxy ether sulphates containing from about 1 to about 12 ethoxy groups per mole and mixtures thereof, said anionic surfactant being present in an amount to provide from about 3% to about 30% of the composition, (ii) a water soluble alkaline detergency builder salt selected from the group consisting of alkaline sodium and potassium carbonates, borates, phosphates, polyphosphates, silicates, polycarboxylates, polyphosphonates, amino polycarboxylates, amino polymethylene phosphonates and mixtures thereof, said detergency builder salt being present in an amount to provide from about 10% to about 80% of the composition, (b) spray during said slurry so as to form free-flowing spray dried granules and (c) spraying said spray dried granules with a tertiary amine in liquid form in an amount of from about 1% to about 25% by weight of the composition, said amine being selected from the group consisting of (i) alkylamines of formula

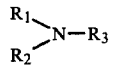

wherein $R_1$ and $R_2$ are each radicals independently selected from $C_{10}$-$C_{26}$ alkyl and alkenyl groups and $R_3$ represents a radical selected from the group consisting of

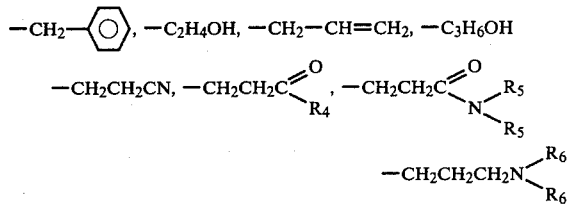

wherein $R_4$ is a $C_1$-$C_4$ alkyl group, each $R_5$ is independently selected from H and $C_1$-$C_4$ alkyl groups and each $R_6$ is independently selected from H and $C_1$-$C_{20}$ alkyl groups and (ii) imidazoline derivatives of formula

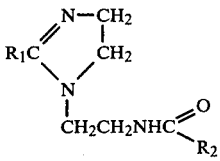

wherein $R_1$ and $R_2$ are as defined above and (iii) mixtures of any of (i) and (ii).

(d) dry mixing oxygen bleaching agent or enzyme or silica/silicone suds suppressor or mixtures thereof with the product of step (c).

2. A method according to claim 1 wherein said amine is molten.

3. A detergent composition adapted to provide fabric softening benefits to textiles washed therewith consisting essentially of, by weight of the composition, (a) from about 3% to about 30% of organic surfactant selected from the group consisting of sodium and potassium $C_9$–$C_{15}$ alkyl benzene sulphonates, $C_{12}$–$C_{18}$ alkyl sulphates and $C_{12}$–$C_{18}$ alkyl polyethoxy ether sulphates containing from about 1 to about 12 ethoxy groups per mole and mixtures thereof, (b) from about 1% to about 25% of alkylamine of the formula

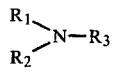

wherein $R_1$ and $R_2$ are each radicals independently selected from $C_{10}$–$C_{26}$ alkyl and alkenyl groups and $R_3$ represents a radical selected from the group consisting of

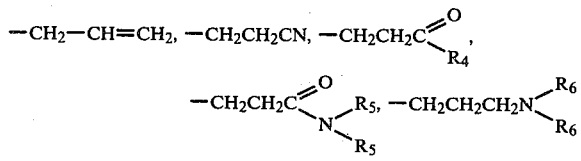

wherein $R_4$ is a $C_1$–$C_4$ alkyl group, each $R_5$ is independently selected from H and $C_1$–$C_4$ alkyl groups and each $R_6$ is independently selected from H and $C_1$–$C_{20}$ alkyl groups (c) from about 10% to about 80% of water soluble alkaline detergency builder salt selected from the group consisting of alkaline sodium and potassium carbonates, borates, phosphates, polyphosphates, silicates, polycarboxylates, polyphosphonates, amino polycarboxylates, amino polymethylene phosphonates and mixtures thereof, such that the pH of a 0.5% by weight aqueous solution of the composition is in the range from about 8.5 to about 11.

4. A detergent composition as recited in claim 3, in which the alkylamine is selected from the group consisting of N, N-ditallowyl trimethylenediamine, N, N, $N^1$, $N^1$ tetratallowyl trimethylenediamine, and mixtures thereof.

5. A detergent composition adapted to provide fabric softening benefits to textiles washed therewith consisting essentially of, by weight of the composition, (a) from about 5% to about 20% by weight of anionic surfactant selected from the group consisting of sodium and potassium $C_9$–$C_{15}$ alkyl benzene sulphonates, $C_{12}$–$C_{18}$ alkyl sulphates and $C_{12}$–$C_{18}$ alkyl polyethoxy ether sulphates containing from about 1 to about 12 ethoxy groups per mole, and mixtures thereof (b) from about 2% to about 15% of alkylamine of formula $R_1R_2R_3N$ wherein $R_1$ and $R_2$ are each radicals independently selected from $C_{10}$–$C_{26}$ alkyl and alkenyl groups and $R_3$ represents a radical selected from the group consisting of

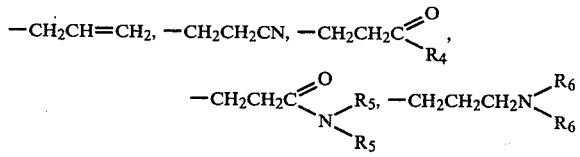

wherein $R_4$ is a $C_1$–$C_4$ alkyl group, each $R_5$ is independently selected from H and $C_1$–$C_4$ alkyl groups and each $R_6$ is independently selected from H and $C_1$–$C_{20}$ alkyl groups (c) from about 10% to about 80% of water soluble alkaline detergency builder salt selected from the group consisting of alkaline sodium and potassium carbonates, borates, phosphates, polyphosphates, silicates, polycarboxylates, polyphosphonates, amino polycarboxylates, amino polymethylene phosphonates and mixtures thereof, and (d) up to about 35% by weight of impalpable smectite-type clay having an ion exchange capacity of at least about 35 meg. per 100 gr, such that the pH of a 0.5% by weight aqueous solution of the composition is in the range from about 8.5 to about 11.

6. A detergent composition as recited in claim 5, in which the alkylamine is selected from the group consisting of N, N-ditallowyl trimethylenediamine, N, N, $N^1$, $N^1$ tetratallowyl trimethylenediamine, and mixtures thereof.

* * * * *

UNITED STATES PATENT AND TRADEMARK OFFICE

CERTIFICATE OF CORRECTION

PATENT NO. : 4,294,710

DATED : October 13, 1981

INVENTOR(S) : Frederick E. Hardy et al.

It is certified that error appears in the above-identified patent and that said Letters Patent are hereby corrected as shown below:

Column 14, line 22, "spray during" should be --spray drying--.

Signed and Sealed this

*Fifteenth* Day of *December 1981*

[SEAL]

*Attest:*

GERALD J. MOSSINGHOFF

*Attesting Officer*

*Commissioner of Patents and Trademarks*